US006275739B1

(12) United States Patent
Ireland

(10) Patent No.: US 6,275,739 B1
(45) Date of Patent: Aug. 14, 2001

(54) ATTACHED LOGIC MODULE TECHNIQUE FOR CONTROL AND MAINTENANCE IN A DISTRIBUTED AND NETWORKED CONTROL SYSTEM

(76) Inventor: Anthony John Ireland, 97 Park Dr., Norcross, GA (US) 30071

( * ) Notice: Subject to any disclaimer, the term of this patent is extended or adjusted under 35 U.S.C. 154(b) by 0 days.

(21) Appl. No.: 09/170,577

(22) Filed: Oct. 13, 1998

Related U.S. Application Data

(60) Provisional application No. 60/062,100, filed on Oct. 14, 1997.

(51) Int. Cl.[7] ..... G05B 11/32; G05D 1/00

(52) U.S. Cl. ..... 700/19; 700/7; 700/24; 701/19; 105/1.5

(58) Field of Search ..... 700/7, 19, 24, 700/27; 701/19, 20; 105/1.5

(56) References Cited

U.S. PATENT DOCUMENTS

| | | | | |
|---|---|---|---|---|
| 4,751,672 | * | 6/1988 | Yamada | 700/7 |
| 5,245,704 | * | 9/1993 | Weber et al. | 709/215 |
| 5,493,642 | * | 2/1996 | Dunsmuir et al. | 345/349 |
| 5,638,522 | * | 6/1997 | Dunsmuir et al. | 345/326 |
| 6,065,406 | * | 5/2000 | Katzer | 105/1.5 |

* cited by examiner

*Primary Examiner*—William Grant
*Assistant Examiner*—Paul Rodriguez

(57) ABSTRACT

A local area network based control system for model railroad layout control that may be readily modified, upgraded, dynamically reconfigured or expanded with minimum physical or functional interruption to the operation of the model railroad layout. This allows for the expansion and improvements to the layout control system to be effected with least effort, time and risk of failure.

9 Claims, 3 Drawing Sheets

Figure 1-Prior Art

ATTACHED LOGIC MODULE TECHNIQUE FOR CONTROL AND MAINTENANCE IN A DISTRIBUTED AND NETWORKED CONTROL SYSTEM

This application claims the benefit of U.S. Provisional Application No. 60/062,100, Oct. 14, 1997.

BACKGROUND OF INVENTION

This invention is in the field of Control Systems for Scale Model Railroad layouts. This field has not been highly technically developed, and does not have existing patents that cover the technologies that are embodied in this invention.

A layout control system is intended to allow a single or number of persons with manual control devices and optional computer(s) and other attached devices to control the operations of locomotives, rolling stock, sections of trackage and associated model components on a scale model railroad layout.

Figure 1:
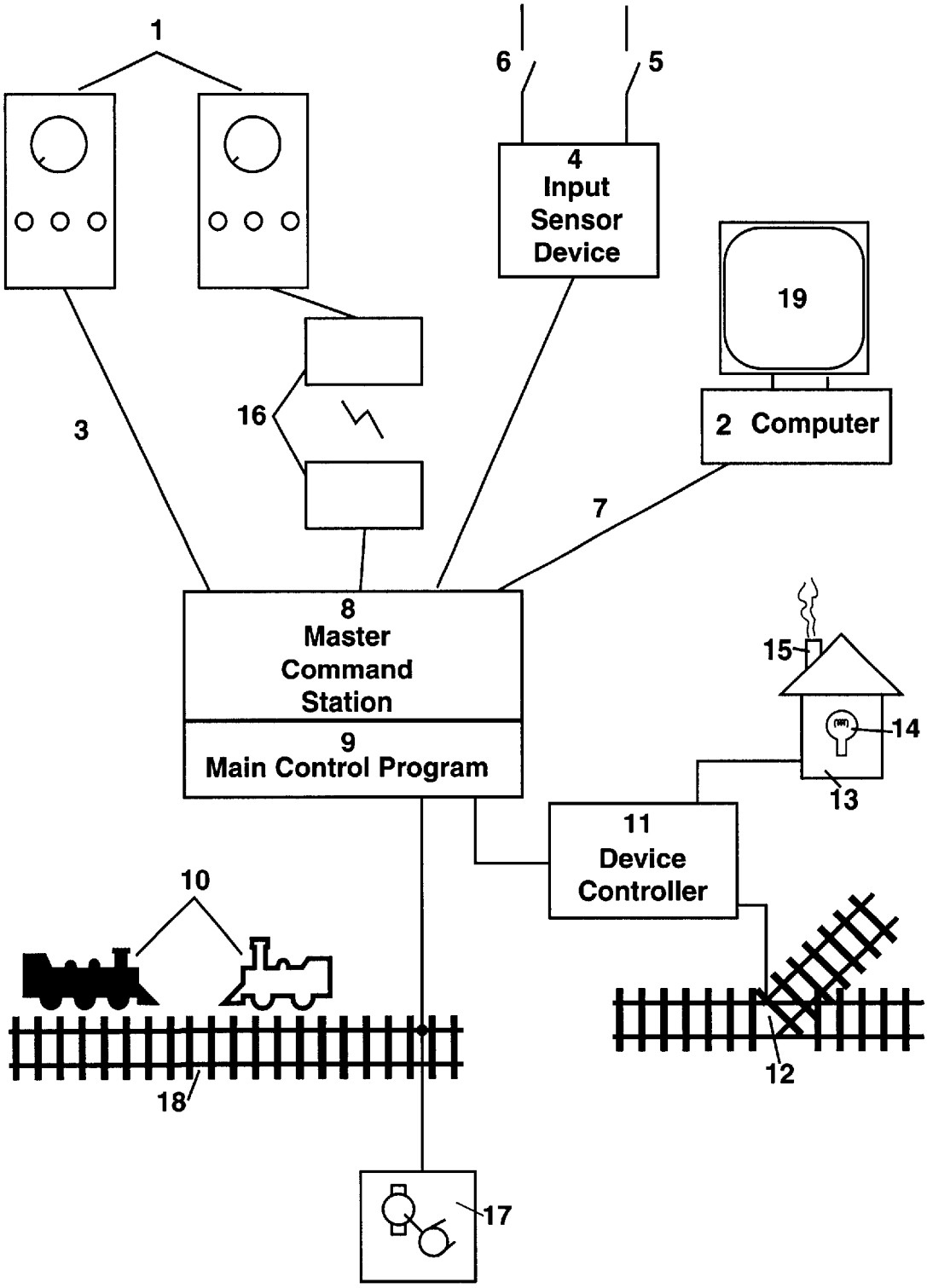

An example of the previous state of the art is shown in FIG. 1. The items in the diagram are easily understood by those practicing the arts of model layout control systems.

The input devices, or throttles, 1 are used by humans for inputting direct manual control over the layout. These throttle devices, 1, allow the user to command actions on the model railroad layout such as; setting speed and direction of specified locomotives, 10, allow selected routing by controlling track turnouts, 12, and other layout animation such as lighting control, 14, smoke generators, 15, in or around layout structures 13. In addition, extra modules such as 17 may be added to give animation via controlled motors, gears, belts, solenoids or other mechanical devices. Manual throttle input devices, 1, or other input devices, 4 are typically connected or tethered by a detachable cable and connector arrangement, 3. This attachment to the Master Command Station may also be effected with a remote or un-tethered link, 16, using for example; Radio frequency, acoustic or Infrared signaling.

The system information and electrical signal flows are mediated and controlled by the Master Command Station, 8. This device scans or electronically interrogates (polls) the system input components and employs the logic embodied in its Main Control Program, 9, to decode input action requests and create the appropriate control signals to communicate to the layout elements such as the trackage, 18, locomotives, 10, attached controller devices 11 and animation elements, 12,14,15 and 17. The Main Control Program (MCP) may be implemented as a combination of software and electronic hardware or wholly as logic implemented in hardware.

In addition to manual inputs its is possible to add a single Personal Computer, 2, connected by data link implementation, 7, running an auxiliary control program, 19, that allows a user to interact and direct actions of the Master Command Station, 8, using a graphical or text based User Interface. Additional inputs may be created by Input sensor device(s), 4, which can take manual switch key inputs from users, 6, or sensor information from locomotive position sensors, 5, and make the information available to the Master Command Station, 8.

The complete layout control system then allows a control strategy to be used to animate the whole layout to simulate real prototypical railroad operations in a scaled miniature form. This type of centralized system architecture is disadvantaged when the layout functions and capabilities need to be modified or expanded. Any changes in device types or numbers must be conveyed to the Main Control Program, 9, residing in the Master Command Station, 8. If this information is not accurate and timely then the system may fail to operate or operate at reduced capability. If a completely new type of device is attached, then the Main Control Program must be replaced with a new version that has the added logic capability needed to integrate a new device correctly. This replacement or upgrade process when executed by an unskilled or untrained service person may lead to partial or complete system failure.

SUMMARY OF INVENTION

This invention allows for the creation of a scale model railroad layout control system using a Local Area Network (LAN) with attached devices to be readily modified, upgraded and expanded at the site of usage with minimum physical or functional interruption. This is a significant advance over the prior state of the art and allows a method for the expansion and improvement to the layout control system to be effected with least effort, time and risk of failure. A network device that can be attached to the network and allow controlled and distributed modification of functionality is termed an Attached Logic Module or ALM.

ATTACHED DRAWINGS: (3 SHEETS)

FIG. 1 details a typical prior-art type of layout control system. It introduces components that are common in layout control systems.

Figure 2:
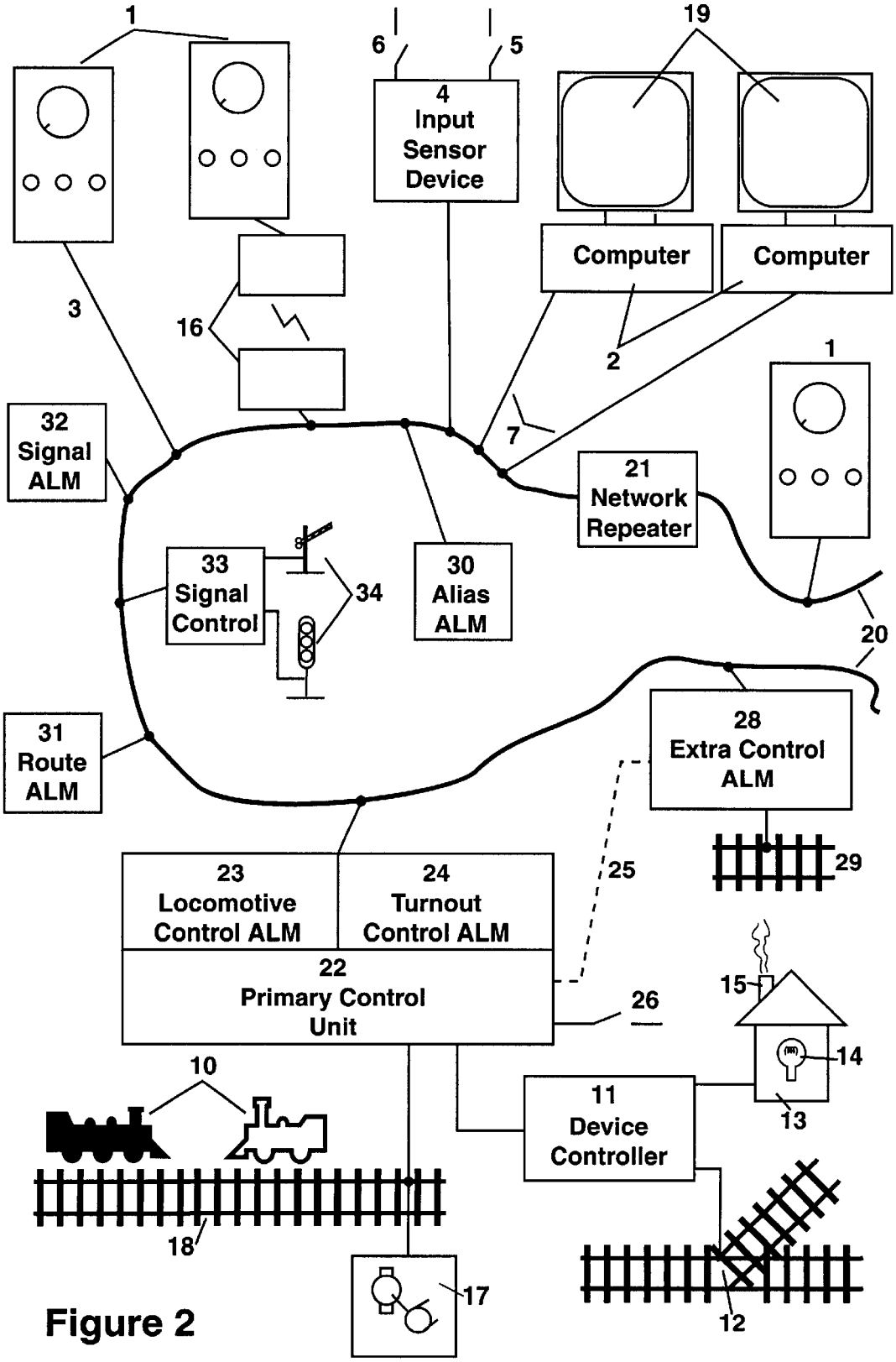

FIG. 2 details the components used in the implementation of the new invention. Several component functions have been described and are the same as used in the description of prior-art.

Figure 3:
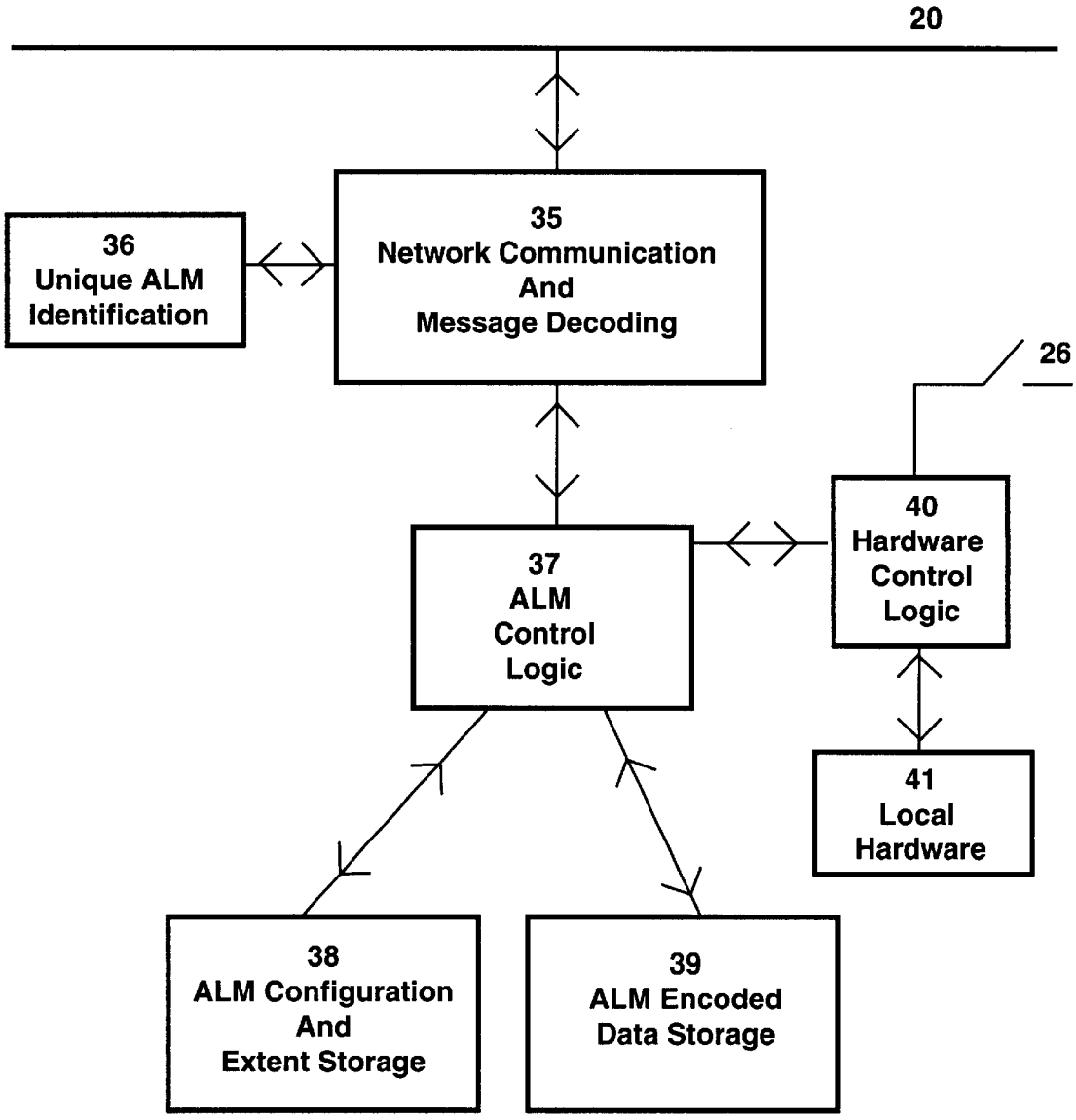

FIG. 3 details the structural or functional components present in an Attached Logic Module implementation.

DETAILED DESCRIPTION OF INVENTION

The new invention described here allows a more powerful and error tolerant method to upgrade or modify the capability of a layout control system. The new state of the art type of control system architecture is shown in FIG. 2. It contains many of the input and layout control devices identified in FIG. 1, using the same naming conventions, along with new devices to be described.

The invention is based upon the unique capabilities of network interconnection that allow bi-directional data flows from many devices along the entire network extent. All devices are able to monitor the data exchanges as they are broadcast along the network. The attached devices are able to communicate to the network with different levels of priority and access controlled by any common Multiple Access strategy known to those skilled at the art of Local Area Network (LAN) design.

A common and widely used LAN access method is Carrier Sense Multiple Access with Collision Detect, CSMA/CD. This technology may be used to allow controlled access by many devices to a single network and employs well known techniques to ensure orderly and distributed network access. A key aspect of LAN technology is that the network data flows, or exchanges between devices, are not mediated by any single Main Control Program in any single device. Orderly and timely network access is guaranteed simply by an attached device correctly following the access rules for the LAN. The access rules for a LAN are distinct from the actual data content or messages and commands that are transmitted when a device has gained network access.

By employing a LAN implementation for the layout control system, it is possible to create the exact equivalent function of the FIG. 1 example Master Control Station, 8, and is controlling Main Control Program (MCP), 9, amongst a number of distributed new devices attached to the network. The unique LAN possibilities of distributed hardware, software and control allows the desired layout system control strategy to be changed by communicating modification commands via the network to functional devices that may then have their operation changed. A network connected device that is designed to allow re configurable operation in this environment, within the scope of this invention, is termed an Attached Logic Module, or ALM.

The LAN communications messages and command protocol used allows for the expansion and addition of new data messages that always follow a basic defined set of message construction rules or syntax. This ensures that any device will always be able to correctly read and validate a network message as error free and correctly formatted, even though it is a message that it might not be able decode and execute. If a validated message is seen that is unrecognized or requires no action, the network device simply discards the message as valid but requiring no action on its part. Commands are interpreted as encoded within valid messages. New types of messages containing new types of commands may be added to the LAN at any time since un-affected devices will simply ignore the messages. Careful application of common network, hardware and software design concepts and practices allows the creation of a system that is tolerant of faults and will work reliably in the presence of disturbances.

In FIG. 2, a Local Area Network, 20, connects all the devices that were previously directly connected to the Master Command Station, 8, of FIG. 1. A Primary Control Unit, 22, replaces item 8 and 9 of FIG. 1.

The data connections symbolized by 3,16 and 7 have been modified in this implementation to allow full network access to the LAN, 20. The LAN may be extended physically and logically with devices such as 21 that allow the network; buffering, bridging (in the LAN sense) or repeating. This allows expansion or fault-tolerance in a larger expanded physical area.

Using a LAN allows the introduction of a second, or more, attached computer(s), 2. Any attached computer may operate independently of others with a variety of auxiliary control programs, 19, that run simultaneously on the network.

The Primary Control Unit 22, that functionally "replaces" the prior art Master Command Station, 9, and MCP, 8, may be subdivided into two ALM components. One ALM section develops control signals for locomotives, 23, and a second ALM section that develops control signals for turnouts or other accessories, 24. The common shared part of the Primary Control Unit, 22, merges all control signals needed for the layout and communicates these to the layout. Using the ALM architecture, the control of locomotives does not require Primary Control Unit, 22, to scan or "poll", for example, the manual throttle input devices, 1. Over the network, the logic within throttle input devices, 1, "converses" with the Locomotive ALM and directly manipulates the associated readable and writable state information stored in the Locomotive ALM, 23. This modified locomotive state information is then processed and communicated to the track, 18, and hence to the locomotives under command, 10.

A basic example of ALM flexibility would be moving the function of the Turnout Control ALM, 24, to one of the attached computers, 2. By issuing a network command that turns off the functionality of device 24 the auxiliary control program, 19, running in the computer, 2, can now emulate the network dialog that the Turnout ALM, 24, normally has with a manual throttle input device, 1. In addition to emulating the functional capability of the Turnout ALM, 24, by virtue of the resources available, the computer can expand the number of turnouts that can be processed by the whole system and maintain expanded state information about these turnouts. In this manner, no hardware changes to either the Throttle input device, 1, or the Primary Control Unit, 22, need be made even though the system capability has been expanded with a new attached device or computer. In this example the attached computer itself is acting as a new ALM, bypassing the superseded system ALM component, 24, that is has switched off. This pre-empting of existing function may occur dynamically while the system is in operation. The computer may also re-enable the Turnout ALM, 24, and return the system to the prior lower level of turnout control capability.

FIG. 2 also shows examples of three other types of ALM that may be beneficially incorporated in the system.

The Alias ALM, 30, is an ALM implementation that keeps a "scratch pad array" or "roster" of locomotive unique 2 digit selection addresses along with an associated 4 digit number that may be used to conveniently refer to it by in the system. A throttle input device, 1, may read this "roster" of associated Alias data entries to refer to locomotives by a new system-wide 4 digit alias code number. The Alias ALM may be edited by another device on the system to create or modify the "roster" of addresses and 4 digit Alias numbers. This form of ALM embodies extra commands that allows the ALM to sort and insert new Alias information in a numerically-sorted order. Each type of ALM may implement a number of unique commands that allow complex data processing, searching or replacements without needing extra network data transactions or delays. An attached computer can copy the data contents of the ALM and then replace it by issuing a command to turn it off on the network. The computer may then assume the Alias ALM function and augment or surpass the original Alias ALM, 30, capability as needed. If the Alias ALM, 30, is implemented within the hardware and software of the Primary Control Unit, 22, then it is a simple matter to add a separate new hardware unit that is a more capable Alias ALM. This new Alias ALM unit can upgrade the complete system Alias capabilities without needing to modify or change the Primary Control Unit, 22.

The Route ALM, 31, is an ALM that keeps an encoded database or list of turnout settings that may be actuated as a group of turnout commands to create a predefined track route on the layout. A route may be activated when the Route ALM monitors a specific encoded turnout change request being broadcast on the network to the Turnout ALM, 24. Upon detecting this trigger condition, the Route ALM, 31, will then send the triggered route's list of turnout commands to the Turnout ALM, 24, to cause the route to be setup on the layout tracks. This ALM has the capability of being modified and configured via the network and can be disabled or preempted by another device performing the Route ALM function.

An Extra control ALM, 28, driving a subsection of the track layout, 29, may also be connected to the LAN, 20. A synchronization connection, 25, is made to the Primary Control Unit, 22. In normal operation the extra control unit may act as another unique version of the Primary Control Unit, 22, and allow the track section 29 to have locomotives and turnouts and other accessories controlled separately from the main layout tracks of 18 and 12. If a locomotive crosses from the main layout tracks to the separate track 29, then the extra control ALM, 28, can detect this and synchronize its track voltages via connection 25 to match the track voltages created by 22. This allows the locomotive to make a smooth transition between the two track areas that normally have different voltages on them. The crossing from the track sections may be detected by any one of a number of types of position sensors or by detecting the voltage matching that occurs when metal wheels bridge the track sections. When the tracks are no longer detected as bridged, the extra control ALM, 28, can return its track voltages to normal independent operation.

The most powerful aspect of ALM based expansion is shown by the Signaling ALM, 32. The Signal ALM, 32, is a layout control device that can monitor all the input sensor and system information such as turnout position and locomotive position and then use this information to calculate the correct "aspect" or display state of trackside signal devices such as train control signal lights or semaphore signals, 34. This enables a more accurate modeling of exactly the way the real or prototype railroads operate with signal and control rules.

The Signal ALM, 32, may passively monitor the information it needs from that broadcast across the network, or it may actively scan or interrogate and modify the information stored in other types of ALMs or network devices such as sensors, 5 and 6 connected via the input device, 4. For example the Signal ALM logic may calculate that a locomotive is approaching a light signal that is displaying "red", indicating that the locomotive must stop. In this case the Signal ALM can be configured to be permitted to directly change the locomotive speed state stored in the locomotive ALM, 23, to a speed of 0, or stopped. If the Signal ALM is switched on or added to a system that is currently in active operation, it may update its internal information to allow correct calculation of layout conditions, by interrogating the state of any or all turnouts in the system by reading from the Turnout ALM, 24, and may interrogate all input device(s), 4, to get an update of all the sensor states. This allows the ALM to maintain synchronization with the true state of the layout. The display of signal lights or semaphore signals is effected by the signal control device, 33, which actually drives the signal units, 34. When the Signal ALM, 32, calculates that a signal must be changed, it generates the appropriate signal command and then broadcasts it to the Signal control, 33, via the network. The signal control device, 33, is accessible over the network and can be incorporated in the hardware and software of the Signal ALM. Since the signal ALM, 32, has ALM capability, it may have its encoded "rules of logic" signal control data, in encoded data storage 39, that specifies how to calculate signal aspects, modified manually via a throttle input device, 1, or via auxiliary control program, 19, running in an attached computer, 2. A multiplicity of Signal ALMs may present on a large layout. Each Signal ALM has a unique identification, 36, that allows it to be addressed and manipulated independently by commands defined for control of Signal ALMs. The unique identification, 36, may be a unique serial number embedded at the ALM manufacture or a unique number written to the unique identification, 36, by an external programming process that can modify the Signal ALM when it is an isolated unit. The addition of a Signal ALM, 32, to the system does not require modification of, and does not adversely impact, existing working network devices, such as manual throttles, 1, sensor devices, 4, or the Primary Control Unit, 22.

The ALM concept allows new functionality to be overlaid on the network while still allowing existing devices to function normally. This is made possible by the distributed control capability of a network in conjunction with messages, commands and rules that are designed to allow the various components to coexist and function autonomously without needing a Main Control Program type of approach. This method of system upgrading or modification by using new Attached Logic Modules avoids the need to directly modify the hardware or software of existing devices and allows a modular type of "plug and play" convenience. In this regard it is superior to the prior art in this field.

New types of ALM capability and command and data structures may be added to any existing layout control system that has ALM capabilities. The new ALM will be constructed using the following descriptive rules and components depicted in FIG. 3:

1) An ALM is a functional sub-unit of the complete control system that is logically connected to the network, can transfer messages in both directions from the network and may be re configured by specific ALM commands sent over the network to modify its capabilities. An ALM may be implemented as a sub-element of the logic or software of a system hardware implementation that supports other capabilities, or may be a physically separate piece of hardware and software connected to the network to specifically implement the desired type of ALM feature. Communication with the network and interpretation of messages and commands is contained in the network communication and message decoding logic, 35, using the unique identifier information in 36. The ALM operates in two distinct modes. The configuration mode occurs when commands are seen that configure or modify the data in 38 or 39 to correctly setup ALM operation. The operational mode occurs at all other times when a message is seen that does not cause the configuration mode to occur.

2) An ALM is addressed uniquely over the network with its related messages and commands. To determine if it is logically present and active on the network it must be interrogated using its related commands. If no reply to an ALM request is seen within a predetermined "time-out" period it is assumed that type of ALM feature or a specific ALM unit is either is not implemented in the system or has been disconnected.

If an ALM is logically present on the network it may be interrogated to determine configuration and extent storage, 38, and the nature and size of its network accessible encoded data storage, 39. Within a specific type of ALM it is possible to have differing levels of implementation of the pre-defined ALM capability. The ALM extent reply will encode and report back to the network exactly what features are implemented in that ALM. The ALM control logic, 37, interprets a decoded message from 35 qualified with a match to the identifier in 36, and performs the requested task to: modify/readback the configuration and extent storage, 38, or modify/readback the encoded data storage, 39. An ALM presents a readable and writable data storage model to the network that represents local encoded data storage of information in a memory array or hardware implemented data registers, 39. The format, encoding and interpretation of the data stored in 39 and the messages and commands used for that type of ALM are uniquely predefined when each type of ALM is first designed. The ALM encoded data storage, 39, may be "null" or unimplemented in versions of ALM devices that are simple enough that no encoded data is needed to complete the assigned actions. The storage elements used to create 38 and 39 may be any type or combination of memory or storage devices and may be volatile or non-volatile with respect to the removal of ALM electrical power.

3) An ALM may have its encoded capabilities and logic modified by commands sent over the network. The ability of these modification commands to be accepted may be optionally controlled by a separate hardware enabling switch 26. This option allows an ALM to be "write protected" from network modification after an ALM is configured, if needed for operational security. The ALM configuration and the network viewed memory address range and size occupied by the encoded data storage, 39, may be modified by changing 38 to allow customizing of features of the ALM. This also allows a number of ALMs of the same type to be managed on the network so that they can share a single, non-interfering and non-overlapping mutual address range for the encoded data, 39, that is addressable by the network.

4) Each class of ALM may have extra data processing, decision making or other capabilities in the control logic, 37, beyond the common ability to be configured and read or written over the network. These extra capabilities are encoded in the extent information, 38, that can be requested. The extra capabilities are created by the ALM control logic, 37, and the manner by which it processes and interprets the data stored in its local encoded data storage, 39. Extra capabilities to operate on the data in 39 include such items as being able to search for and report the location of specific data values, the ability to sort and reorder the data in 39 based on a command for the network and the ability to delete or insert a new encoded data entry in 39. An ALM may be enabled by its configuration to actively access the network and read or modify data in other devices or ALMs on the network.

5) When an ALM is in the operational mode, the ALM control logic, 37, reviews all network messages received by the network communication logic 35 and checks against the configuration, 38, and encoded data storage, 39, to interpret if an action is required, and if so, what type of action is required. An action may involve sending a new command or message back to the network via 35, or may involve acting on optional local hardware, 41, via hardware control logic, 40, to create signals or voltages to perform actions in attached devices. To be acted upon by the ALM, the messages the ALM reviews do not need to specifically ALM messages and do not need to have embedded identification corresponding to 36. The bi-directional arrows on the interconnections between the elements in FIG. 3 indicate that information and data or signals may logically flow in either direction between the elements.

In this control system and ALM functional description the exact form of messages, command encoding and configuration and encoded data used in the initial reduction to practice have not been explicitly given. These are implementation specific and may be varied to meet the exact requirements of the network and hardware for each type of system that may implement ALMs, without diminishing the power or utility of the concept of ALMs.

The exact form of hardware and signal voltages used to control items, 10, 11, 12, 13, 14, 15, 17, 18, 29 and 34 on the layout have not been explicitly defined since a number of approaches commonly known to those with skills in creating layout control systems may be used to create the hardware and control these layout items.

Also not included in this discussion arc the common corrective methods used in the art of diligently designed network and computer systems to ensure correct and continued operation when data errors, device unavailability or other exceptions to normal operation occur. Persons of normal skills in the art of network, computer and logic design may synthesize implementations to create ALMs using the described characteristics of ALMs and the layout control system.

What is claimed:

1. A method for control in a model railroad layout using digital command control signal voltages using automated synchronization of adjacent gap isolated main track section and separate track section employing unrelated control voltages comprising at least:

(a) providing a means to generate and conduct unique main track section control voltages to said main track section;

(b) providing a means to generate unique track control voltages for said separate track section;

(c) providing an automated control sub-unit comprising at least:

(i) providing a means for obtaining samples of said unique main track section control voltages and said unique separate track section control voltages, (ii) providing a means for selecting between said samples of unique main track section control voltages and said samples of unique separate track section control voltages and conducting the selected voltage to said separate track section (iii) providing a means for detecting when model wheels cross between the gap isolating said main track section and said separate track section (iv) providing a means for deciding, when model wheels are crossing said gap between said main track section and said separate track section, that the control voltage selected to be conducted to said separate track section will be approximately equal to the value of the voltage sample obtained from said unique main track section (v) providing a means for deciding, when model wheels have completed crossing from said main track section across said gap into said separate track section, that the control voltage selected to be conducted to said separate track section will be approximately equal to said sample of the unique separate track section control voltage which will;

allow the passage of wheeled units crossing said gap between said main track section and said separate track section to occur with minimum disruption to said main track section by synchronizing the voltages at each side of the gaps while allowing the two track areas to have completely unrelated and not simply reversed polarity control voltages when it is decided that passage is not occurring.

2. The method for control in a model railroad layout using digital command control signal voltages using automated synchronization of adjacent gap isolated main track section and separate track section employing unrelated control voltages of claim 1, further including:

providing a means of alternating said sample of main track section voltage and said sample of separate track section voltage conducted to the separate track section; alternated in such a manner as to effectively allow the control of models in the separate track section which have crossed said gap between main track section and separate track section and continue to be controlled by the main track section voltage.

3. A method of maintenance of a distributed network model railroad control system, comprising:

(a) providing a local area network, without centralized mediation;

(b) providing a plurality of sub units connected to said local area network, said plurality of sub units providing a control structure for said distributed network model railroad control system;

(c) providing a local area network command syntax means for said plurality of sub units;

(d) independently configuring said distributed network model railroad control system with said plurality of sub units using said local area network command syntax means;

(e) providing a message decoding means for said plurality of sub units; said message decoding means providing bi-directional data transfer capability, distributed decentralized multiple access control and for said plurality of sub units to send messages and commands and configuration information to any other connected sub unit and to receive said messages and commands and configuration information from said any other connected sub unit connected to said local area network;

(f) providing a control logic means for said plurality of sub units, said control logic means functioning autonomously without centralized mediation on said distributed network model railroad control system, whereby said plurality of sub units independently configure said distributed network model railroad control system and provide maintenance of said distributed network model railroad control system without centralized mediation over said local area network.

4. A method of maintenance and control which allows addition of at least one new type of functionality to a model railroad control system based on a distributed network through addition of at least one attached logic module added to said distributed network, comprising:

(a) providing said at least one attached logic module, (b) providing a connecting means between said model railroad control system based on a distributed network and to said at least one attached logic module, (c) providing a network command syntax means that allows for addition of said at least one new type of functionality by adding at least one new message type and associated commands via said at least one attached logic module to implement said at least one new type of functionality on said model railroad control system based on a distributed network, (d) said step of providing said at least one attached logic module further comprising:

(i) providing a network communication means for communicating between said at least one attached logic module and said model railroad control system based on a distributed network, (ii) providing a message decoding means for said at least one attached logic module to have bidirectional data transfer capability, distributed decentralized multiple access control and having the ability for said at least one attached logic module to send messages and commands and configuration information to any other connected attached logic module and to receive said messages and commands and configuration information from said any other connected attached logic module without centralized mediation, (iii) providing a control logic means for said at least one attached logic module to function autonomously without centralized mediation on said model railroad control system based on distributed network techniques, (iv) providing an autonomous configuration means for said at least one attached logic module to add said at least one new message type and associated commands to implement addition of said at least one new type of functionality to a model railroad control system based on the distributed network, whereby application of said at least one attached logic module to said model railroad control system based on a distributed network will enable an end-user to add new functionality automatically to said model railroad control system based on a distributed network.

5. A method of maintenance and control which allows modification of at least one type of functionality to a model railroad control system based on a distributed network through addition of at least one attached logic module added to said distributed network, comprising:

(a) providing said at least one attached logic module, (b) providing a connecting means between said model railroad control system based on a distributed network and said at least one attached logic module, (c) providing a network command syntax means that allows for said modification of at least one type of functionality to said model railroad control system based on a distributed network, (d) said step of providing said at least one attached logic module further comprising:

(i) providing a network communication means for communicating between said at least one attached logic module and said model railroad control system based on a distributed network, (ii) providing a message decoding means for said at least one attached logic module to have bi-directional data transfer capability, distributed decentralized multiple access control and having an ability for said at least one attached logic module to send messages and commands and configuration information to any other connected attached logic module and to receive said messages and commands and configuration information from said any other connected attached logic module without centralized mediation, (iii) providing a control logic means for said at least one attached logic module to function autonomously without centralized mediation on said model railroad control system based on distributed network techniques, (iv) providing an autonomous configuration means for said at least one attached logic module to change said configuration information in said any other connected attached logic module to make said modification of at least one type of functionality to a model railroad control system based on the distributed network, whereby application of said at least one attached logic module to said model railroad control system based on a distributed network will automatically enable said modification of at least one type of functionality to said model railroad control system based on a distributed network by an end-user.

6. The method of claim 5 wherein the modification of at least one type of functionality is route control on said model railroad control system based on a distributed network.

7. The method of claim 5 wherein the modification of at least one type of functionality is signal control on said model railroad control system based on a distributed network.

8. The method of claim 5 wherein the modification of at least one type of functionality is locomotive address alias control on said model railroad control system based on a distributed network.

9. The method of claim 5 wherein the step of providing said at least one attached logic module further includes adding a write protection means to said at least one attached logic module for preventing distributed network modifications, thereby providing operational security following said autonomous configuration.

* * * * *